US006974663B2

(12) United States Patent
Bringley et al.

(10) Patent No.: US 6,974,663 B2
(45) Date of Patent: Dec. 13, 2005

(54) SILVER HALIDE IMAGING ELEMENT CONTAINING INTERCALATED PHOTOGRAPHICALLY USEFUL COMPOUNDS

(75) Inventors: Joseph F. Bringley, Rochester, NY (US); Krishnamohan Sharma, Rochester, NY (US); Kenneth J. Lushington, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 357 days.

(21) Appl. No.: 10/036,669

(22) Filed: Dec. 21, 2001

(65) Prior Publication Data

US 2004/0096786 A1 May 20, 2004

(51) Int. Cl.[7] ..... G03C 1/08; G03C 7/26; G03C 7/32

(52) U.S. Cl. ..... 430/546; 430/505; 430/543; 430/544; 430/559; 430/551; 430/566; 430/570; 430/597; 430/590; 430/599; 430/606; 430/607; 430/631

(58) Field of Search ..... 430/505, 543, 430/544, 546, 559, 566, 570, 551, 597, 598, 599, 606, 607, 631

(56) References Cited

U.S. PATENT DOCUMENTS

| | | | | |
|---|---|---|---|---|
| 5,208,139 A | | 5/1993 | Ishigaki | |
| 5,372,919 A | | 12/1994 | Nielsen et al. | |
| 5,827,637 A | | 10/1998 | Uchida et al. | |
| 5,827,638 A | | 10/1998 | Tsukahara et al. | |
| 5,840,474 A | | 11/1998 | Andriessen et al. | |
| 5,891,611 A | | 4/1999 | Majumdar et al. | |
| 5,955,190 A | | 9/1999 | Majumdar et al. | |
| 5,981,126 A | | 11/1999 | Majumdar et al. | |
| 6,010,836 A | * | 1/2000 | Eichorst et al. | 430/527 |
| 6,013,427 A | * | 1/2000 | Eichorst et al. | 430/527 |
| 6,060,230 A | * | 5/2000 | Christian et al. | 430/527 |
| 6,261,757 B1 | | 7/2001 | Irving et al. | |
| 6,376,057 B1 | | 4/2002 | Akao et al. | |

FOREIGN PATENT DOCUMENTS

| | | |
|---|---|---|
| EP | 757 285 | 2/1995 |
| EP | 0 738 918 | 10/1996 |
| JP | 2000155390 | 6/2000 |

OTHER PUBLICATIONS

Research Disclosure No. 12924; Jan. 1975; pp. 27–30; "Incorporated Dye–Forming Blocked Developers"; William R. Schleigh et al.

* cited by examiner

*Primary Examiner*—Geraldine Letscher
(74) *Attorney, Agent, or Firm*—Andrew J. Anderson

(57) ABSTRACT

A photographic element is described comprising a support bearing one or more hydrophilic colloid layers including at least one photographic silver halide emulsion layer, wherein a photographically useful compound is incorporated into at least one hydrophilic colloid layer in the form of an intercalation composition comprising a layered host material having molecules of the photographically useful compound inserted as guest molecules between the layers of the host material. The invention provide novels materials and a method of incorporating active chemistry compounds such as developers or development inhibitors directly into a photographic imaging element with improved stability and keeping response versus known methods for incorporating active chemistry compounds.

17 Claims, No Drawings

SILVER HALIDE IMAGING ELEMENT CONTAINING INTERCALATED PHOTOGRAPHICALLY USEFUL COMPOUNDS

FIELD OF THE INVENTION

The present invention relates to a method of incorporating photographically useful compounds into a hydrophilic colloid layer of a photographic element, and to photographic elements containing intercalated photographically useful compounds incorporated therein.

BACKGROUND OF THE INVENTION

Substances necessary for obtaining a photographic image or compounds for obtaining a photographic image of higher quality are called photographically useful compounds. The photographic process, in its most basic form, is comprised of silver halide (capable of detecting light and storing it as latent image) and developer molecules (capable of converting the latent image to a visible image). These two chemistries, however, are incompatible, as unexposed silver halide is thermodynamically unstable with respect to reduction in the presence of developer molecules. Silver halide may also be unstable with respect to other additional photographically useful compound chemistries, which we will refer to using the term 'active chemistry'. Examples of other potentially active chemistries in addition to developing agents include auxiliary developing agents, development accelerators, dyes, fogging agents, silver halide solvents, couplers, compounds which accelerate coupling reaction of couplers, bleaching accelerators, fixing accelerators and development inhibitors. The consequence of this is that many photographic components must be kept separate, each function performed in sequence and thus, modern photography requires multiple steps: exposure and processing.

Incorporation of active chemistry directly into film formulations, to either simplify or improve processing after exposure, has long been a goal in the photographic industry. Some photographically useful compounds are difficult to incorporate in a stable fashion into a light-sensitive material, however, or cause serious deterioration in the photographic capability if incorporated. These compounds, if incorporated directly into the photographic elements, typically need to be stabilized or rendered harmless by chemical modification prior to photographic processing. Methods of incorporating development and other active chemistries into photographic element formulations have been described in a number of patents and publications. Schleigh and Faul, in Research Disclosure 129 (1975) describe methods of appending color developers with "blocking" chemistry to prevent premature reaction. U. S. Pat. No. 6,261,757 to Irving et al. describes photographic articles in which developers and other photographic chemistries are ionically bound to the surface of ion-exchange resins. However, in such prior art methods imaging elements obtained are still frequently subject to poor keeping characteristics. It would be desirable to provide alternative methods for obtaining an imaging element with active chemistry photographically useful compounds directly incorporated therein, which exhibits good photographic photographic performance as well as excellent keeping characteristics.

SUMMARY OF THE INVENTION

In accordance with one embodiment of the invention, a photographic element is described comprising a support bearing one or more hydrophilic colloid layers including at least one photographic silver halide emulsion layer, wherein a photographically useful compound is incorporated into at least one hydrophilic colloid layer in the form of an intercalation composition comprising a layered host material having molecules of the photographically useful compound inserted as guest molecules between the layers of the host material.

The invention provides novel materials and a method of incorporating active chemistry compounds such as developers or development inhibitors directly into a photographic imaging element with improved stability and keeping response versus known methods for incorporating active chemistry compounds.

DETAILED DESCRIPTION OF THE INVENTION

In accordance with the invention, a photographically useful compound is incorporated into at least one hydrophilic colloid layer of a photographic element in the form of an intercalation composition. Intercalation is a process in which a layered material, referred to as the host, swells or opens to accommodate other molecules or ions, referred to as the guest.

$$\text{Host+guest} \text{ - - - } \rightarrow \text{Host(guest)}_x$$

Layered compounds capable of sequestering ions and molecules by intercalation have been described in a number of publications. The choice of host material is dependent upon the particular molecule to be intercalated. A layered host material may be chosen which intercalates only cations, or conversely, only anions, or neutral molecules. The choice of layered host materials for practice of the invention can be discerned from reviewing the wide body of literature available on intercalation chemistry and intercalation compounds. The following publications are included for reference on this matter: *"Intercalation Chemistry"*, A. J. Jacobson and S. Whittingham, eds., Academic Press, NY 1982; *"Intercalated Layered Materials"*, F. Levy, D. Riedel Press, Dordrecht, Holland (1979); W. T. Reichle, CHEMTECH, 16, 58 (1986); *"An Introduction to Clay Colloid Chemistry"*, H. van Olphen, 2$^{nd}$ Ed., Krieger Pub. Co., Malabar, Fla. (1991).

Preferred layered host materials for use in the present invention include:

1) Layered metal hydrogen phosphate structures of the formula:

$$M(HPO_4)_2{:}yH_2O;$$

where M is Zr, Ti, Sn, Ge or Hf or any combination thereof; and y is a rational number between 0 and 10.

2) Layered double hydroxides of the general formulas:

$$[M^{2+}{}_{1-x}M^{3+}{}_x(OH)_2]A^{n-}{}_{x/n}\bullet yH_2O$$

or $$[M^{1+}M^{3+}{}_2(OH)_6]A^{n-}{}_{x/n}{\cdot}yH_2O;$$

or hydroxy double salts of the general formula:

$$(M1^{2+}, M2^{2+})_5(OH)_8{\cdot}(A^{n-})_{2/n}\bullet yH_2O;$$

where $M^{1+}$ is a monovalent metal selected from but not limited to Li, Na, K, Rb or Cs; and $M^{2+}$, $M1^{2+}$ or $M2^{2+}$ is a divalent metal selected from but not limited to Ca, Mg, Mn, Co, Ni, Cu, Zn, and Cd; and $M^{3+}$ is a trivalent metal selected from but not limited to Cr, Fe, Al, Ga, In, Mo; A is an anion chosen from $OH^-$, $NO_3^-$, $F^-$, $Cl^-$, $Br^-$, $I^-$, $ClO_4^{2-}$, $SO_4^{2-}$, $CO_3^{2-}$ or any inorganic or organic anion, especially carboxylates and sulfonates chosen such that the rule of charge neutrality is obeyed; n is an integer and x and y may be any rational number between 0 and 1, and between 0 and 10, respectively.

3) Layered siliceous materials such as natural or synthetic clay minerals exemplified by montmorillonite, bentonite, kaolin, magadiite, hectorite, vermiculite, smectites, beidellite, fluorohectorite, talc, muscovite and saponite or given by the general formula:

$$[M1, M2]_nZ_4O_{10}(OH)_{2-y}H_2O_{-w}M3;$$

where M1 is a metal selected from Al, Fe, Mn or Co and M2 is a metal selected from Mg, Fe, Ni, Zn or Li; Z is Al or Si; $H_2O$ is chemically absorbed water and M3 is a cation selected from, but not limited to K, Na, Li or Ca. n is a number from 0 to 4, y is a number from 0 to 10 and w is a number from 0 to 1.

Intercalation of layered materials creates complex materials consisting of guest molecules or ions captured within the host matrix. The layers of the host solid, typically only a few angstroms thick, exfoliate and swell in direct proportion to the size of the guest molecules. The number of guest molecules captured within the layers is determined by their size and the charge of the guest and the host. The process is reversible such that the guest molecules or ions can later be recovered from the complex system.

As indicated above, the preferred choice of host material is dependent upon the particular molecule to be intercalated. In order to facilitate intercalation of a desired photographically useful compound into a layered host material it may be necessary to prepare functionalized derivatives of the desired compound such that the compound molecule attains a positive or negative charge. To prepare a cation, this may be typically achieved by derivatizing the photographically useful compound molecule with an onium ion group, e.g., an amine or quaternary amine, or phosphonium ion. To prepare an anion, a carboxylic or sulfonic acid function, or a sulfate group, may be attached to the parent photographically useful compound molecule. The selection of derivatized photographically useful compound molecules will be readily apparent to one skilled in the art.

Photographically useful compounds which may be intercalated into a layered host material for incorporation into at least one hydrophilic colloid layer of a photographic element in accordance with the invention include developing agents, auxiliary developing agents, development accelerators, dyes, fogging agents, silver halide solvents, couplers, compounds which accelerate coupling reaction of couplers, bleaching accelerators, fixing accelerators, electron transfer agents, antifogging agents, keeping agents, sequestraints, chemical sensitizers and development inhibitors, or other organic and inorganic molecules capable of performing a photographic function. The invention is particularly useful in the context of incorporating active chemistry in the form of developing agents (e.g., catechol, hydroquinone, aminophenol, sulfonamidophenol, aminopyrazolone, phenylenediamine, ascorbic acid derivative), auxiliary developing agents (e.g., 1-phenylpyrazolidin-3-one derivative), development accelerators (e.g., mesoionic compound), fogging agents, antifogging agents (e.g., dinitrobenzoic acid, 4-carboxymethyl-4-thiazoline-2-thione), chemical sensitizers (e.g., aurous thiomalate), silver halide solvents, photographic couplers, or development inhibitors (e.g., benzotriazole, 5-mercapto-tetrazole, 2-mercapto-1,3, 4-thiadiazole derivative), and especially developing agents, auxiliary developing agents or development inhibitors, which compounds have been particularly problematic upon incorporation into photographic elements with respect to providing good photographic performance upon processing while maintaining excellent keeping characteristics.

In accordance with one particularly preferred embodiment of the invention, molecules commonly used as developer agents or auxiliary developing agents in the photographic process can be intercalated into a wide variety of layered compounds as discussed above including $Zr(HPO_4)_2.H_2O$, layered double hydroxides, montmorillonite clays, and hydroxy double salts. The developer molecules may be any developer selected from those commonly known in the art. A detailed description of photographic development chemistry is given in "*The Theory of the Photographic Process*", T. H. James, 4th ed. Eastman Kodak Company, Chapters 11–15, (1977). Specific examples of developing agents and the auxiliary developing agents include hydroquinones, catechols, p-aminophenols, p-phenylenediamine, 1-phenyl-3-pyrazolidones, reductones, sulfonamidophenols, sulfonamidonaphthols, aminohydroxypyrazoles, aminopyrazolines, hydrazines and hydroxylamines. Among these, preferred black and white development agents are hydroquinones and their derivatives, para-aminophenols and ascorbic acid. Preferred color developer molecules include para-phenylenediamine and derivatives thereof. Inorganic developing agents include hydroxylamine, compounds of $Sn^{2+}$, dithionite and hydrazine. In accordance with the invention, developer molecules commonly used in the photographic process can be intercalated into host layered materials, and the developers can be released from the host layers upon introduction of basic aqueous solution or by ion exchange via the introduction of cations or anions into the system. Developer processing solutions are typically both basic and contain a high concentration of cations and anions. Silver halide imaging elements containing the intercalated developing agents may be capable of forming imagewise density when exposed to a basic aqueous solution. Imaging elements containing such intercalated developers also have been demonstrated to exhibit higher photographic speed, lower fog and better environmental keeping than imaging elements containing unintercalated developer molecule.

In accordance with another preferred embodiment of the invention, molecules commonly used as development inhibitors in the photographic process can be intercalated into layered compounds as discussed above. The intercalated inhibitor molecules may be based upon any inhibitor selected from those commonly known in the art. Common photographic inhibitors include 1-phenyl-5-mercaptotetrazole (PMT), 5-mercaptotetrazole, benzotriazole (BTAZ), benzimidazole (BZ), 2-mercaptobenzothiazole, 2-mercaptobenzoxazole, 2-mercaptothiazoline, diethyldithiocarbamate, and iodide ions. An intercalation compound can generally be prepared of an inhibitor if it contains, or is modified to contain, a charged group. Inhibition chemistry is commonly used in photographic systems to manipulate photographic properties such as tone scale, contrast, fog and color. Inhibiton chemistry, as the word implies, generally slows the rate of development of silver halide imaging elements, and while allowing a film designer to manipulate the properties mentioned above, generally results in an overall loss of system photographic speed and contrast when incorporated in a photographic element. This is because the free inhibitor when added to photographic grains strongly absorbs to their surfaces and "inhibits" developer chemistry from gaining access to the surfaces.

The present invention provides a method of inhibiting development which does not result in an overall speed loss but still allows control of contrast, as when the inhibitor chemistry is intercalated into layered compounds it is thus sequestered or encapsulated by the layered host. The layered host materials effectively isolate the inhibitor from the silver halide grains until the time of development, at which time ion exchange occurs and the inhibitor chemistry is released and interacts with the system. Inhibition of a photographic system may be obtained with no concomitant speed loss and unexpectedly, in some cases, a speed gain.

In accordance with another preferred embodiment of the invention, molecules commonly used as antifogging agents in the photographic process can be intercalated into layered compounds as discussed above. The intercalated antifogging molecule may be based upon any antifoggant selected from those commonly used in the art. Common photographic antifoggants include dinitrobenzoic acid, 4-carboxymethyl-4-thiazoline-2-thione, 2-mercaptobenzothiazole, 3-isothiuronium-propane sulfonate, and p-glutaramidophenyl disulfide. Antifoggants commonly are employed to reduce the dmin or fog level of a photographic coating. However, the addition of such addenda often results in a photographic speed loss. The present invention provides a method of incorporating antifoggant which does not result in an overall speed loss, as when the antifogging chemistry is intercalated into layered compounds it is thus sequestered or encapsulated by the layered host. The layered host materials effectively isolate the antifoggant from the silver halide grains until the time of development, at which time ion exchange occurs and the antifogging chemistry is released and interacts with the system. Further, the intercalated antifogging compounds impart excellent keeping properties to the photographic element with little dmin growth and speed loss over time.

Photographically useful compounds may be intercalated into a layered material structure by various procedures. In a typical preparation the solid host compound having a particle size of less than 50 $\mu$m, and preferably less than 10 $\mu$m, and more preferably less than 1 $\mu$m is added to distilled water and a suspension is formed by rapid stirring. The aqueous medium may comprise plain water, or a hydrophilic colloid composition. The guest compound to be intercalated is then added to the suspension either as a pure component or as a solution in water or a non-aqueous solvent. The mixture is allowed to stir for many hours or until until the intercalation process is complete. Gentle heating may be applied to the mixture to excelerate the intercalation process if necessary. Non-aqueous solvents or mixtures may also be employed to carry out the reaction. The reaction progress may be monitored using powder X-ray diffraction and other analytical techniques. Powder X-ray diffraction provides direct information regarding the average distance between two adjacent layers of the layered host compound, commonly called the interlayer spacing. As intercalation proceeds the guest molecules enter between the layers and thus the interlayer spacing typically increases to account for the guest molecule. The interlayer spacing typically increases in direct proportion to the size of the guest molecule. Other analytical techniques such as elemental analysis may be used to confirm the extent of reaction. After the intercalations step, the resulting intercalated composition may be recovered by filtration, centrifugation or other means and may be washed free of any un-intercalated molecules and may then be stored until which time it is prepared for incorporation into a photographic element. The compound may be added as a free solid or may be prepared by dispersing the soild into water or non-aqueous medium or into an aqueous hydrophillic colloid meiudm such as gelatin, or into a hydrophobic or hydrophillic polymer medium.

Compositions of layered materials and intercalated photographically useful compounds prepared in accordance with the invention may be incorporated in photographic element hydrophilic colloid layer coating compositions. A typical photographic light-sensitive material is based on hydrophilic colloid layers comprising silver halide emulsion compositions, though other types of materials are known using various other kinds of light-sensitive components. The intercalated photographically useful compound compositions may be incorporated into a light sensitive emulsion layer or any other hydrophilic colloid layer.

Intercalated photographically useful compound compositions prepared in accordance with the invention may be useful for single color elements (including black and white) or multicolor photographic elements. Silver halide multicolor elements typically contain a support and image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. Various arrangements and constructions of silver halide color photographic materials may be employed for different types of imaging processes including, for example, diffusion transfer color photography and silver dye bleach color photography. Mixed grain photographic products and multilayer products are also known.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. If desired, a photographic element containing a dispersed photographically useful compound in accordance with the invention can be used in conjunction with an applied magnetic layer as described in *Research Disclosure*, November 1992, Item 34390 published by Kenneth Mason Publications, Ltd., Dudley House, 12 North Street, Emsworth, Hampshire P010 7DQ, ENGLAND.

Suitable materials for use in photographic emulsions and elements that can be used in conjunction with intercalated compositions prepared in accordance with the invention are further described in *Research Disclosure*, September 1994, Item 36544, available as described above. The contents of the *Research Disclosure*, including the patents and publications referenced therein, are incorporated herein by reference, and the Sections hereafter referred to are Sections of the *Research Disclosure*, Item 36544. Silver halide emulsions which may be employed in photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX. It is also specifically contemplated that the materials and processes described in an article titled "Typical and Preferred Color Paper, Color Negative, and Color Reversal Photographic Elements and Processing," published in *Research Disclosure*, February 1995, Volume 370 may also be advantageously used with elements prepared in accordance with the invention. It is further specifically contemplated that the elements of the invention may further be used in combination with the various photographic compounds and systems such as described in U.S. Pat. No. 6,261,757 to Irving, et al., the disclosure of which is incorporated herein.

The hydrophilic colloid in the hydrophilic colloid layers of the element of the present invention is a binder or protective colloid for the usual silver halide photographic light-sensitive materials. Gelatin is most preferably used as binder or protective colloid in the present invention, though, of course, other hydrophilic colloids may also be used. Other suitable hydrophilic materials include, for example, gelatin derivatives, graft copolymers comprising gelatin and other polymeric materials, albumin, casein and other forms of protein, cellulose derivatives such as hydroxyethyl cellulose, carboxymethyl cellulose, the sulfuric acid ester of cellulose, etc., carbohydrate derivatives such as sodium alginate, starch and its derivatives, etc., various synthetic polymer materials such as poly(vinyl alcohol), partially acetalized poly(vinyl alcohol), poly-N-vinylpyrrolidone, poly(acrylic acid), poly(methacrylic acid), polyacrylamide, polyvinylimidazole, polyvinylpyrazole, etc., and copolymers consisting of the monomer unit contained in the above cited polymers.

Among various types of gelatin, one can use alkaline processed gelatin, acid processed gelatin, the hydrolyzed product therefrom, or the peptized product therefrom with an enzyme. Suitable gelatin derivatives include the reaction products obtained by subjecting gelatin to reactions with a number of reagents such as acid halide, such anhydride, isocyanate, bromoacetic acid, alkane sultone, vinylsulfonamide, maleinimide, polyalkylene oxide, epoxide, etc. Reference can be made to U.S. Pat. Nos. 2,614,928, 3,132,945, 3,186,846 and 3,312,553, British Pat. Nos. 861,414, 1,033,189 and 1,005,784, Japanese Patent Publication No. 26845/67, etc. Representative hydrophilic synthetic polymeric materials include those described in, for example, German Patent Application (OLS) No. 2,312,708, U.S. Pat. Nos. 3,620,751 and 3,879,205, Japanese Patent Publication No. 7561/68.

EXAMPLES

Preparation of Materials

Layered Host Materials (a) $Zr(HPO_4)_2.H_2O$: Into 500 ml of distilled water was dissolved 200.0 g of $ZrOCl_2.8H_2O$. This solution was then added dropwise to a hot solution (80–90° C.) of 42.5% phosphoric acid in 1500 ml of water with vigorous stirring. After the addition was complete the reaction mixture was stirred at 90° C. for 18 h. The solid product was then collected by filtration and carefully washed with 2.0 l of water and 300 ml of ethanol, yielding 177 g of a white solid. The purity of the product was confirmed by powder X-ray diffraction.

(b) Calcined HYCITE 713: $Mg_{0.7}Al_{0.3}(OH)_2.0.15CO_3$ (HYCITE 713) was obtained from Sud-Chemie Co. and was pre-treated as follows: 50.00 g of the white powder was heated in air at 500° C. for 3 hours and cooled to room temperature.

(c) Laponite: $(Mg_{2.75}Li_{0.15})[Si_4O_{10}(OH)_2]$: 0.7 $Na^+$ (Laponite-RD) was obtained from Southern Clay Corp and used as received.

(d) $Zn_5(OH)_8.2acetate.2H_2O$: Into 200 g of distilled water was placed 81.5 g of ZnO and the mixture stirred rapidly to form a suspension. A separate solution was made by dissolving 222.0 g of $Zn(acetate)_2.2H_2O$ in 1000 mL of distilled water. The metal acetate solution was filtered and then added rapidly to this suspension of ZnO. The final reaction mixture was vigorously stirred for two days at 50° C. The product was filtered and washed with copious amounts of distilled water and air dried.

TABLE 1

Compounds and their chemical structures used in examples and identified by acronym

| Name | Chemical formula |
|---|---|
| CD2 | 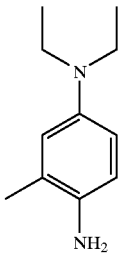 |
| CD3 | 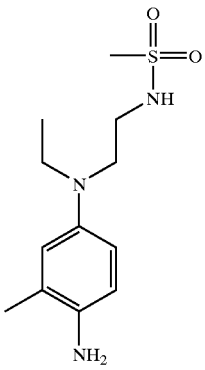 |
| CD4 | 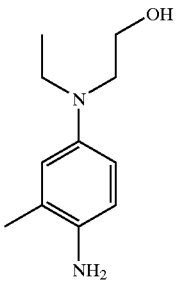 |

TABLE 1-continued
Compounds and their chemical structures used in examples and identified by acronym
| Name | Chemical formula |
|---|---|
| HQ11 | 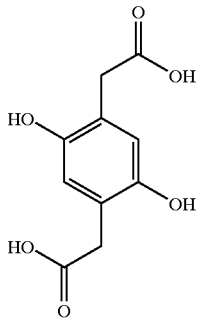 |
| CD11 | 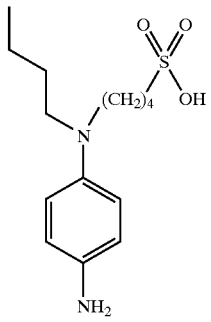 |
| TMBD | 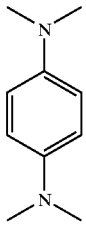 |
| ELON | 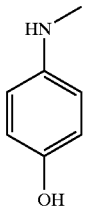 |
| PMT | 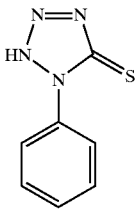 |
| BZ | 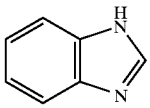 |
TABLE 1-continued
Compounds and their chemical structures used in examples and identified by acronym
| Name | Chemical formula |
|---|---|
| APMT | 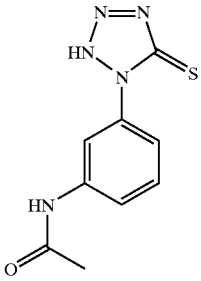 |
| GSD-1 | 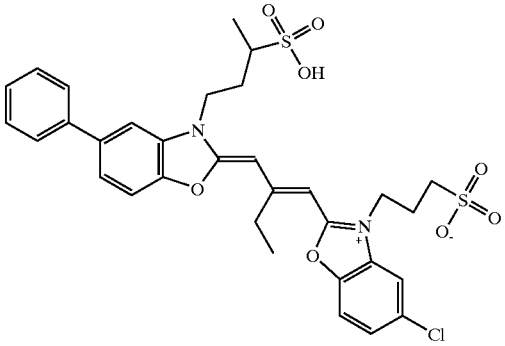 |
| RSD-1 | 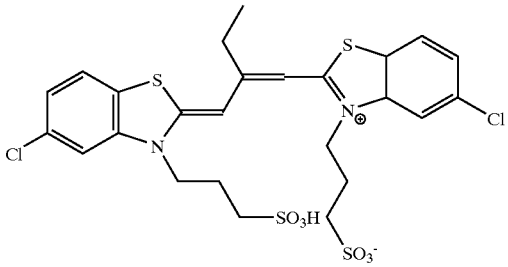 |
| RSD-2 | 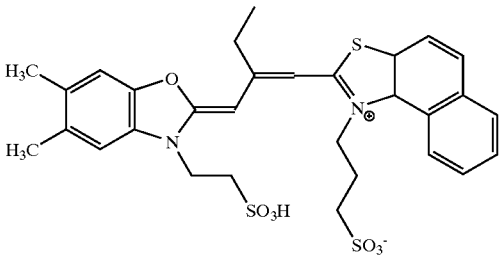 |

TABLE 1-continued

Compounds and their chemical structures used in examples and identified by acronym

| Name | Chemical formula |
|---|---|
| CC-1 | 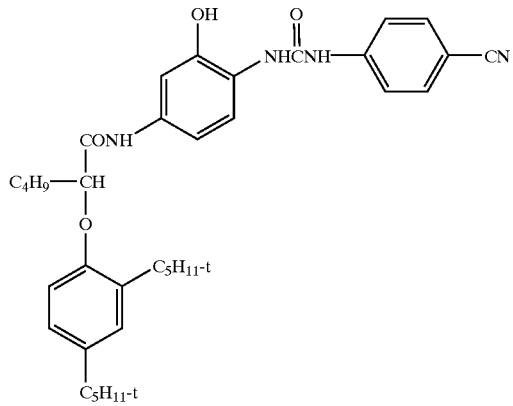 |

Intercalated Developer I (ID-1)

$Zr(HPO_4)_2(CD4)_{0.55}$ $nH_2O$: Into 250.0 g distilled water was placed 10.00 g of $Zr(HPO_4)_2.H_2O$. To the stirred suspension was then added 26.0 ml of 2.5 M NaOH. This was allowed to stir for about 1 hour and the contents were degassed with nitrogen. 4.85 g of CD4 were then added, along with a small amount (0.22 g) of $Na_2SO_3$ antioxidant. The contents were then stirred for 24 hours under nitrogen and the solid recovered by centrifugation and washed three times with pure distilled water. Elemental analysis was consistent with the composition shown above and powder X-ray diffraction indicated an increase in the interlayer lattice spacing of 6.5 Å, the increase in interlayer spacing is indicative of the insertion of additional molecules between the host layers.

Intercalated Developer II (ID-2)

$Zr(HPO_4)_2(CD2)_{0.50}$ $nH_2O$: Into 75.0 g distilled water was placed 2.00 g of $Zr(HPO_4)_2.H_2O$. To the stirred suspension was then added 26.6 ml of 0.25 M NaOH. This was allowed to stir for about 1 hour and the contents were degassed with nitrogen. 2.85 g of CD2 were then added, along with a small amount (0.090 g) of $Na_2SO_3$ antioxidant. The contents were then stirred for 24 hours under nitrogen and the solid recovered by centrifugation and washed three times with pure distilled water. Elemental analysis was consistent with the composition shown above and powder X-ray diffraction indicated an increase in the interlayer lattice spacing of 7.2 Å, the increase in interlayer spacing is indicative of the insertion of additional molecules between the host layers.

Intercalated Developer III (ID-3)

$Zr(HPO_4)_2(CD3)_{0.33}nH_2O$: Into 200.0 g distilled water was placed 20.00 g of $Zr(HPO_4)_2.H_2O$. To the stirred suspension was then added 49.2 ml of 2.5 M NaOH. This was allowed to stir for about 1 hour and the contents were degassed with nitrogen. 30.00 g of CD3 were then added, along with a small amount (0.500 g) of $Na_2SO_3$ antioxidant. The contents were then stirred for 36 hours under nitrogen and the solid recovered by centrifugation and washed three times with pure distilled water. Elemental analysis was consistent with the composition shown above and powder X-ray diffraction indicated an increase in the interlayer lattice spacing of 6.4 Å, the increase in interlayer spacing is indicative of the insertion of additional molecules between the host layers Intercalated Developer IV (ID-4)

$Zr(HPO_4)_2(hydroxylamine)_{2.0}$ $nH_2O$: Into 200.0 g distilled water was placed 10.00 g of $Zr(HPO_4)_2.H_2O$. To the stirred suspension was then added 25.0 ml of 2.5 M NaOH. This was allowed to stir for about 1 hour and the contents were degassed with nitrogen. 10.00 g of hydroxylamine sulfate were then added and the contents were then stirred for 24 hours under nitrogen. The solid was recovered by centrifugation and washed three times with pure distilled water. Elemental analysis was consistent with the composition shown above and powder X-ray diffraction indicated an increase in the interlayer lattice spacing of 1.9 Å, the increase in interlayer spacing is indicative of the insertion of additional molecules between the host layers Intercalated Developer V (ID-5)

$Zr(HPO_4)_2(TMBD)_{0.32}$ $nH_2O$: Into 100.0 g distilled water was placed 10.00 g of $Zr(HPO_4)_2.H_2O$. To the stirred suspension was then added 26.6 ml of 2.5 M NaOH. This was allowed to stir for about 1 hour and the contents were degassed with nitrogen. 13.0 g in 110 ml distilled water of TMBD were then added. The contents were then stirred for 48 hours under nitrogen and the solid recovered by centrifugation and washed three times with pure distilled water. Elemental analysis was consistent with the composition shown above and powder X-ray diffraction indicated increases in the interlayer lattice spacing of 10.4 Å and 3.6 Å, multiple interlayer lattice spacings are indicative of multiple orientations of the guest molecules between the layers.

Intercalated Developer VI (ID-6)

$Mg_{0.7}Al_{0.3}(OH)_2.0.3$ HQ11 $nH_2O$: Into 87.00 g of distilled water was dissolved 0.78 g of HQ11. 1.00 g of calcined HYCITE 713 was then added to the solution and the contents stirred under nitrogen for 3 days at 50° C. The solid was then recovered by filtration and washed with distilled water and ethanol. Elemental analysis was consistent with the composition shown above and powder X-ray diffraction indicated an increase in the interlayer lattice spacing indicative of the insertion of additional molecules between the host layers.

Intercalated Developer VII (ID-7)

$Mg_{0.7}Al_{0.3}(OH)_2.0.3$ CD11 $nH_2O$: Into 85.00 g of distilled water was dissolved 2.05 g of CD11 and the pH adjusted to pH=3 with dilute $HNO_3$. 1.0 g of calcined HYCITE 713 was then added to the solution and the contents stirred under nitrogen for 3 days at 50° C. The solid was then recovered by filtration and washed with distilled water and ethanol. Elemental analysis was consistent with the composition shown above and powder X-ray diffraction indicated an increase in the interlayer lattice spacing of 6.2 Å, the increase in interlayer spacing is indicative of the insertion of additional molecules between the host layers.

Intercalated Developer VIII (ID-8)

$Zr(HPO_4)_2(ELON)_{0.5}$ $nH_2O$: 11.10 g ELON hydrogen sulfate was dissolved in a mixture of 75.0 g water and 25.0 g ethanol. To the stirred suspension was then added 10.0 g of $Zr(HPO_4)_2.H_2O$. The pH of the suspension was then adjusted to pH=3.0 with aqueous NaOH and the contents allowed to stir for about 3 days. The solid was recovered by filtration and washed with water. Elemental analysis was consistent with the composition shown above and powder X-ray diffraction indicated an increase in the interlayer lattice spacing of 6.2 Å, the increase in interlayer spacing is indicative of the insertion of additional molecules between the host layers.

Intercalated Developer IX (ID-9)

$[(Si_8Mg_{5.5}Li_{0.3})O_{20}(OH)_4]0.6$ hydroxylammonium: Into 150.0 g of distilled water was dissolved 5.0 g of hydroxylamine sulfate. 5.00 g of Laponite-RD was then added to the solution and the contents stirred under nitrogen for 18 hours at 50° C. The solid was then recovered by filtration and washed with distilled water and ethanol. Elemental analysis was consistent with the composition shown above.

Intercalated Inhibitor I (IH-1)

$Zr(HPO_4)_2(BZ)_{1.37}$ $nH_2O$: Into 250.0 g distilled water was placed 10.00 g of $Zr(HPO_4)_2.H_2O$. To the stirred suspension was then added 7.36 g benzimidazole (BZ) and the contents allowed to stir for about 5 days at pH=6.9. The solid was recovered by vacuuum filtration and washed carefully with water. Elemental analysis was consistent with the composition shown above and powder X-ray diffraction indicated an increase in the interlayer lattice spacing indicative of the insertion of additional molecules between the host layers.

Intercalated Inhibitor II (IH-2)

$Mg_{0.7}Al_{0.3}(OH)_2.0.3$ PMT $nH_2O$: 10.00 g 1-phenyl-5-mercaptotetrazole (PMT) was placed in 250 ml of distilled water and to the stirred ssuspension under nitrogen was added 8.21 of calcined HYCITE 713. After 1 hour the pH was adjusted to 7.5 by the addition of 1 N nitric acid. The mixture was then stirred at 50° C. for 3 hours and at 25° C. for 4 days. The product was collected by vacuum filtration and washed with ethyl alcohol. Elemental analysis was consistent with the composition shown above and powder X-ray diffraction indicated an increase in the interlayer lattice spacing of 9.4 Å, the increase in interlayer spacing is indicative of the insertion of additional molecules between the host layers.

Intercalated Inhibitor III (IH-3)

$Mg_{0.77}Al_{0.23}(OH)_2.0.23$ I $nH_2O$: 20.00 g of calcined HYCITE 713 was suspended in 200 g distilled water under nitrogen gas and 15.00 g NaI and 23.0 ml of 55% HI were added slowly with stirring. The contents were stirred for 18 hours and the product collected by vacuum filtration. Elemental analysis was consistent with the composition shown above and powder X-ray diffraction indicated an interlayer lattice spacing of 8.2 Å, indicative of the insertion of iodide ion between the host layers.

Intercalated Antifoggant I (IAF-1)

$Zn_5(OH)_8.2DNB.2H_2O$: 20.00 g of dinitrobenzoic acid (DNB) was dissolved in 300.00 ml of distilled water and the pH adjusted to 4.64 by the addition of 35.00 ml of 2.5 M aqueous NaOH. 15.00 g of $Zn_5(OH)_8.2acetate.2H_2O$ was then added and the mixture stiired for 40 hours at 55° C. The solid was then recovered by filtration and washed with distilled water and ethanol. Elemental analysis was consistent with the composition shown above and powder X-ray diffraction indicated an increase in the interlayer lattice spacing of 4.1 Å, the increase in interlayer spacing is indicative of the insertion of additional molecules between the host layers.

Imaging Elements

Component coating coverages, in parentheses, are reported in $g/m^2$. Silver halide coating coverages are based upon the weight of silver. A series of photographic elements were constructed as follows: The grains in the imaging layer were in each instance silver (iodo)bromide tabular grains with tabular grains of the indicated thickness accounting for 99.9 percent of total grain projected area. The elements were hardened with bis(vinylsulfonyl)methane hardener (0.27) uniformly distributed through all of the gelatin containing layers. The antifoggant 4-hydroxy-6-methyl-1,3,3a,7-tetraazaindene was employed, and the elements contained other conventional addenda that remained unchanged from element to element and that did not participate in dye image formation, such as surfactants, high boiling solvents, coating aids, sequestrants and lubricants. The coatings were prepared on a cellulose acetate support.

The elements received identical stepped 365 nm line exposures to allow density (D) versus exposure (log E) characteristic curves to be plotted. The exposed elements were processed in the Kodak Flexicolor™ C-41 color negative process described in *British Journal of Photography Annual,* 1988, pp. 196–198. The resulting cyan dye images were analyzed and compared for speed relative to a control. Speed was measured at a toe density Ds, where Ds minus Dmin equals 20 percent of the slope of a line drawn between Ds and a point D' on the characteristic curve offset from Ds by 0.6 log E. Dmin was mesured as the minimum density for a given exposure. Keeping tests were performed by aging the elements in the dark in an atmosphere carefully controlled at 35° C. and a relative humidity of 50%.

Example 1

An imaging layer comprising silver iodobromide emulsion (2.5 μm ECD×0.13 μm, 3.3 mole % I, based on total silver) at (0.81), cyan coupler CC-1 at (1.61), CD-4 delivered from ID-1 at (0.003) and gelatin at (3.23), and a protective overcoat layer with gelatin at (2.69) were coated on a celluose acetate photographic support.

Example 2

Same as example 1 except CD-4 delivered from ID-1 at (0.006).

Example 3

Same as example 1 except CD-4 delivered from ID-1 at (0.016).

Comparsion Example 4

Same as example 1 except ID-1 was not added and in its place CD-4 was added directly at (0.003).

Comparsion Example 5

Same as example 1 except ID-1 was not added and in its place CD-4 was added directly at (0.016).

TABLE 2

Dmin arid photographic speed for examples 1–5 immediately after coating and after keeping at 1 week at 35° C. and 50% R.H.

| Example or Comparison | CD-4 | | fresh | fresh | 1 week at 35° C./ 50% R.H. | |
|---|---|---|---|---|---|---|
| example | from ID-1 | CD-4 | Dmin | Speed | Dmin | Speed |
| 1 | 0.003 | | 0.0 | 100 | +0.11 | 143 |
| 2 | 0.006 | | +0.02 | 82 | +0.11 | 110 |
| 3 | 0.0016 | | 0.0 | 110 | +0.11 | 117 |
| Com. Ex. 4 | | 0.003 | +0.09 | 40 | +0.13 | 75 |
| Com. Ex. 5 | | 0.0016 | 0.0 | 82 | +0.13 | 84 |

The above examples demonstrate that imaging elements containing intercalated color developer give coatings with greater fresh photographic speed and also significantly greater speed and lower fog (Dmin) upon keeping. These results further demonstrate that the inorganic layered host effectively sequesters the intercalated color developer molecules until the time of development.

Example 6

Same as example 1, except the imaging layer comprised a red-sensitized (with RSD-1 and RSD -2) silver iodobromide emulsion (3.5 μm ECD×0.13 μm, 3.7 mole % I, based on total silver) at (0.81), cyan coupler CC-1 at (1.61), CD-4 delivered from ID-1 at (0.0030, and gelatin at (3.23), and a protective overcoat layer with gelatin at (2.69) were coated on a celluose acetate photographic support.

Example 7

Same as example 6 except CD-4 delivered from ID-1 at (0.006).

Example 8

Same as example 6 except CD-4 delivered from ID-1 at (0.016).

Comparison Example 9

Same as example 6 except ID-1 was not added and in its place CD4 was added directly at (0.003).

Comparison Example 10

Same as example 6 except ID-1 was not added and in its place CD-4 was added directly at (0.016).

TABLE 3

Dmin and photographic speed for examples 6–10 immediately after coating and after keeping at 1 week at 35° C. and 50% R.H.

| Example or Comparison | CD-4 | | fresh | fresh | 1 week at 120° F./50% R.H. | |
|---|---|---|---|---|---|---|
| example | from ID-1 | CD-4 | Dmin | Speed | Dmin | Speed |
| 6 | 0.003 | | 0.0 | 100 | +0.10 | 127 |
| 7 | 0.006 | | +0.004 | 100 | +0.11 | 120 |
| 8 | 0.0016 | | +0.07 | 72 | +0.17 | 88 |
| Com. Ex. 9 | | 0.003 | +0.02 | 83 | +0.14 | 95 |
| Com. Ex. 10 | | 0.0016 | +0.01 | 85 | +0.19 | 92 |

The above examples demonstrate that spectrally-sensitized imaging elements containing intercalated color developer give coatings with greater fresh photographic speed and also significantly greater speed and lower fog (Dmin) upon keeping. These results further demonstrate that the inorganic layered host effectively sequesters the intercalated color developer molecules until the time of development.

Example 11

Same as example 1, except the imaging layer comprised a red-sensitized (with RSD-1 and RSD-2) silver iodobromide emulsion (3.5 μm ECD×0.13 μm, 3.7 mole % I, based on total silver) at (0.81), cyan coupler CC-1 at (1.61) and gelatin at (3.23), and the overcoat layer comprised gelatin at (3.26) and CD-4 delivered from ID-1 at (0.016).

Example 12

Identical to example 11 except CD-4 delivered from ID-1 in the overcoat layer at (0.032)

Example 13

Identical to example 11 except ID-1 was not added and CD-4 was added directly in the overcoat layer at (0.016).

TABLE 4

Dmin and photographic speed for examples 11–13 immediately after coating and after keeping at 1 week at 35° C. and 50% R.H.

| Example or Comparison | CD-4 from ID-I In | CD-4 In | fresh | fresh | 1 week at 35° C./50% R.H. | |
|---|---|---|---|---|---|---|
| example | overcoat | overcoat | Dmin | Speed | Dmin | Speed |
| 11 | 0.016 | | 0.00 | 100 | +0.15 | 123 |
| 12 | 0.032 | | 0.00 | 102 | +0.18 | 121 |
| Com. Ex. 13 | | 0.016 | 0.00 | 93 | +0.20 | 93 |

Example 14

An imaging layer comprising silver iodobromide emulsion (2.5 μm ECD×0.13 μm, 3.3 mole % I, based on total silver) at (0.81), cyan coupler CC-1 at (1.61), ELON delivered from ID-8 at (0.016) and gelatin at (3.23), and a protective overcoat layer with gelatin at (2.69) were coated on a celluose acetate photographic support.

Example 15

Same as example 14 except ELON delivered from ID-8 at (0.082).

Example 16

Same as example 14 except ELON delivered from ID-8 at (0.163).

Comparison Example 17

Same as example 14 except ID-8 was not added and in its place ELON was added directly at (0.016).

TABLE 5

Dmin and photographic speed for examples 14–17.

| Example or Comparison example | ELON from ID-8 | ELON added directly | fresh Dmin | fresh Speed |
|---|---|---|---|---|
| 14 | 0.016 | | 0.0 | 100 |
| 15 | 0.082 | | +0.005 | 72 |
| 16 | 0.163 | | +0.008 | 54 |
| Com. Ex. 17 | | 0.016 | +0.020 | 40 |

The above examples demonstrate that imaging elements containing intercalated color developer, give coatings with greater fresh photographic speed and also significantly lower fresh fog (Dmin). These results further demonstrate that the inorganic layered host effectively sequesters the intercalated color developer molecules until the time of development.

Comparison Example 18

An imaging layer comprising green sensitized (with GSD-1) silver iodobromide emulsion (2.9 μm ECD×0.13 μm, 3.7 mole % I, based on total silver) at (0.8 1), cyan coupler CC-1 at (1.61) and gelatin at (3.23), and a protective overcoat layer with gelatin at (2.69) were coated on a cellulose acetate photographic support.

Example 19

Same as example 18 except BZ was delivered at (0.0002) into imaging layer coating melt from IH-1.

Example 20

Same as example 18 except BZ delivered at (0.002) into imaging layer coating melt from IH-1.

Comparison Example 21

Same as example 18 except BZ added directly to imaging layer coating melt at (0.0002).

Comparison Example 22

Same as example 18 except BZ added directly to imaging layer coating melt at (0.002).

TABLE 6

Photographic performance parameters for examples and comparison examples 18–22.

| Example or Comparison example | BZ from IH-1 ($g/m^2$) | BZ ($g/m^2$) | fresh Speed | Change in Dmax |
|---|---|---|---|---|
| Com. Ex. 18 | — | — | 100 | — |
| 19 | 0.0002 | | 93 | −0.01 |
| 20 | 0.002 | | 100 | −0.08 |
| Com. Ex. 21 | | 0.0002 | 87 | −0.03 |
| Com. Ex. 22 | | 0.002 | 83 | −0.06 |

The results of Table 6 show that the inhibitor when released from the intercalated compound during processing results in less photographic speed loss, while still providing inhibition of the photographic emulsion as evidenced by the loss in optical density in the Dmax region of the curve. The use of a layered host as a "vehicle" for photographic inhibitors thus delays the release of inhibitors until the time of development and essentially allows for inhibition while minimizing photographic speed loss.

Comparison Example 23

Same as example 18, except imaging layer comprised a red-sensitized (with RSD-1 and RSD-2) silver iodobromide emulsion (3.5 $\mu$m ECD×0.13 $\mu$m, 3.7 mole % I, based on total silver) at (0.81), and cyan coupler CC-1 at (1.61) and gelatin at (3.23).

Example 24

Same as comparison example 23 except PMT delivered at (0.001) to emulsion layer coating melt from IH-2.

Comparison Example 25

Same as comparison example 23 except the inhibitor APMT added at (0.001) to emulsion layer coating melt. Both PMT and APMT are well known to stongly inhibit photographic development. The molecules are identical with the exception that APMT contains an amide group connected to the phenyl ring of PMT. APMT was used in this example because PMT is only sparingly soluble in water at the pH of coating. The amide group increases the solubility of APMT relative to PMT.

TABLE 7

Photographic performance parameters for example and comparison examples 23–25.

| Example or Comparison example | PMT from IH-2 | APMT | fresh Speed | Change in Maximum contrast | Change in Dmax |
|---|---|---|---|---|---|
| Com. Ex. 23 | — | — | 100 | — | — |
| 24 | 0.001 | | 117 | −0.24 | −0.07 |
| Com. Ex. 25 | | 0.001 | 78 | −0.10 | −0.03 |

The results of Table 7 show that the inhibitor PMT when delivered from the intercalated compound (IH-2) gives an unexpected speed increase. Further the results of Table 2 show that the intercalated compound still causes inhibition of the photographic emulsion as evidenced by the loss in contrast and Dmax. Again, the encapsulation or sequestering of the inhibitor by the layered host matrix essentially delays the release of the inhibitor until the time of development. The speed increase observed is a surprising result and is unanticiapted based upon what is known in the art regarding inhibitor chemistry.

Example 26

Same as comparison example 23 except the antifoggant DNB delivered at (0.05) to emulsion layer coating melt from IAF-1.

Example 27

Same as comparison example 23 except the antifoggant DNB delivered at (0.10) to emulsion layer coating melt from IAF-1.

TABLE 8

Photographic performance parameters for examples and comparison examples 23, 26 and 27.

| Example or Comparison | DNB from | fresh | fresh | 1 week at 35° C./50% R.H. | |
|---|---|---|---|---|---|
| example | IAF-1 | Dmin | Speed | Dmin | Speed |
| 26 | 0.05 | 0.087 | 99 | +0.06 | 100 |
| 27 | 0.10 | 0.092 | 99 | +0.06 | 100 |
| Com. Ex. 23 | | 0.083 | 100 | +0.17 | 96 |

The results of Table 8 show that the antifoggant compound delivered from the intercalated compound IAF-1 results in a photographic element with exceptional keeping characteristics as Dmin growth is small upon keeping. Further, the speed of the examples containing IAF-1 is relatively unchanged upon keeping as compared to a comparison experiment in which the intercalated compound is not added.

The invention has been described in detail with particular reference to certain preferred embodiments thereof, but it will be understood that variations and modifications can be effected within the spirit and scope of the invention.

What is claimed is:

1. A photographic element comprising a support bearing one or more hydrophilic colloid layers including at least one photographic silver halide emulsion layer, wherein a photographically useful compound is incorporated into at least one hydrophilic colloid layer in the form of an intercalation composition comprising a layered host material having molecules of the photographically useful compound inserted as guest molecules between the layers of the host material.

2. A photographic element according to claim 1 wherein the photographically useful compound comprises a developing agent, auxiliary developing agent, development accelerator, dye, fogging agent, silver halide solvent, coupler, compound which accelerates coupling reaction of couplers, bleaching accelerator, fixing accelerator, electron transfer agent, antifogging agent, keeping agent, sequestraint, chemical sensitizer or development inhibitor.

3. A photographic element according to claim 1 wherein the photographically useful compound comprises a photographic developer compound.

4. A photographic element according to claim 1 wherein the photographically useful compound comprises a photographic development inhibitor compound.

5. A photographic element according to claim 1 wherein the photographically useful compound comprises a photographic antifoggant compound.

6. A photographic element according to claim 1 wherein the layered host material comprises a layered metal hydrogen phosphate structure of the formula:

$$M(HPO_4)_2{:}yH_2O;$$

where M is Zr, Ti, Sn, Ge or Hf or any combination thereof; and y is a rational number between 0 and 10.

7. A photographic element according to claim 1 wherein the layered host material comprises a layered double hydroxide structure of the formulas:

$$[M^{2+}{}_{1-x}M^{3+}{}_{x}(OH)_2]A^{n-}{}_{x/y}\bullet yH_2O \text{ or } [M^{1+}M^{3+}{}_2(OH)_6]A^{n-}{}_{x/n}\cdot yH_2O;$$

or hydroxy double salt of the general formula:

$$(M1^{2+},M2^{2+})_5(OH)_8\cdot(A^{n-})_{2/n}\bullet yH_2O;$$

where $M^{1+}$ is a monovalent metal; $M^{2+}$, $M1^{2+}$ and $M2^{2+}$ are divalent metals; and $M^{3+}$ is a trivalent metal; A is any inorganic or organic anion, chosen such that the rule of charge neutrality is obeyed; n is an integer and x and y may be any rational number between 0 and 1, and between 0 and 10, respectively.

8. A photographic element according to claim 7 wherein where $M^{1+}$ is Li, Na, K, Rb or Cs; $M^{2+}$, $M1^{2+}$ and $M2^{2+}$ are Ca, Mg, Mn, Co, Ni, Cu, Zn, or Cd; $M^{3+}$ is Cr, Fe, Al, Ga, In, or Mo; and A is $OH^-$, $NO_3^-$, $F^-$, $Cl^-$, $Br^-$, $I^-$, $ClO_4^{2-}$, $SO_4^{2-}$, or $CO_3^{2-}$.

9. A photographic element according to claim 8 wherein A is a carboxylate or sulfonate anion.

10. A photographic element according to claim 1 wherein the layered host material comprises a layered siliceous material.

11. A photographic element according to claim 10 wherein the layered host material comprises a natural or synthetic clay minerals.

12. A photographic element according to claim 11 wherein the layered host material comprises montmorillonite, bentonite, kaolin, magadiite, hectorite, vermiculite, smectites, beidellite, fluorohectorite, talc, muscovite or saponite.

13. A photographic element according to claim 10 wherein the layered host material comprises a natural or synthetic clay minerals given by the formula:

$$[M1,M2]_nZ_4O_{10}(OH)_2\cdot{}_yH_2O\cdot{}_wM3;$$

where M1 is a metal selected from Al, Fe, Mn or Co and M2 is a metal selected from Mg, Fe, Ni, Zn or Li; Z is Al or Si; $H_2O$ is chemically absorbed water; M3 is a cation; and n is a number from 0 to 4, y is a number from 0 to 10 and w is a number from 0 to 1.

14. A photographic element according to claim 13 wherein M3 is a cation selected from K, Na, Li or Ca.

15. A photographic element according to claim 1 wherein the intercalation composition is contained in the silver halide emulsion layer.

16. A photographic element according to claim 1 wherein the intercalation composition is contained in a hydrophilic colloid layer adjacent to a silver halide emulsion layer.

17. A method for preparing a photographic element, comprising forming an intercalation composition comprising a layered host material having molecules of a photographically useful compound inserted as guest molecules between the layers of the host material, adding the intercalation composition to a hydrophilic colloid layer coating composition, and coating the hydrophilic colloid layer coating composition to form a layer of the photographic element.

* * * * *